US005398375A

United States Patent [19]

Niederquell

[11] Patent Number: 5,398,375

[45] Date of Patent: Mar. 21, 1995

[54] FOLDING HANDLE ASSEMBLY

[76] Inventor: Hans J. E. Niederquell, 4433 W. Van Buren #10, Phoenix, Ariz. 85043

[21] Appl. No.: 124,077

[22] Filed: Sep. 21, 1993

[51] Int. Cl.[6] ..... E05B 1/00
[52] U.S. Cl. ..... 16/112; 16/115
[58] Field of Search ..... 16/112, 110 R, 115, 16/111 R, 125, 126; 294/167, 168, 169; 273/148 B, 438

[56] References Cited

U.S. PATENT DOCUMENTS

| | | | |
|---|---|---|---|
| 1,933,637 | 11/1933 | Plym | 16/112 |
| 2,723,329 | 11/1955 | Baird | 16/115 |
| 4,589,162 | 5/1986 | Manz et al. | 16/115 |

FOREIGN PATENT DOCUMENTS

| | | | |
|---|---|---|---|
| 2629126 | 9/1989 | France | 16/115 |

*Primary Examiner*—P. Austin Bradley
*Assistant Examiner*—Chuck Y. Mah
*Attorney, Agent, or Firm*—H. Gordon Shields

[57] ABSTRACT

A folding game chair includes a handle secured to a pivoting plate, and movement of the handle causes the plate to pivot. A handle is movable between a down, storage position and an up, use position and is locked in the up, use position and the down, storage position by mechanical elements. The elements include a compression spring which extends between a bushing appropriately secured to the plate and a pin secured to the handle. To move the handle between its two positions, the handle is moved sideways or laterally against the bias of the compression spring.

12 Claims, 2 Drawing Sheets

FIG. 1
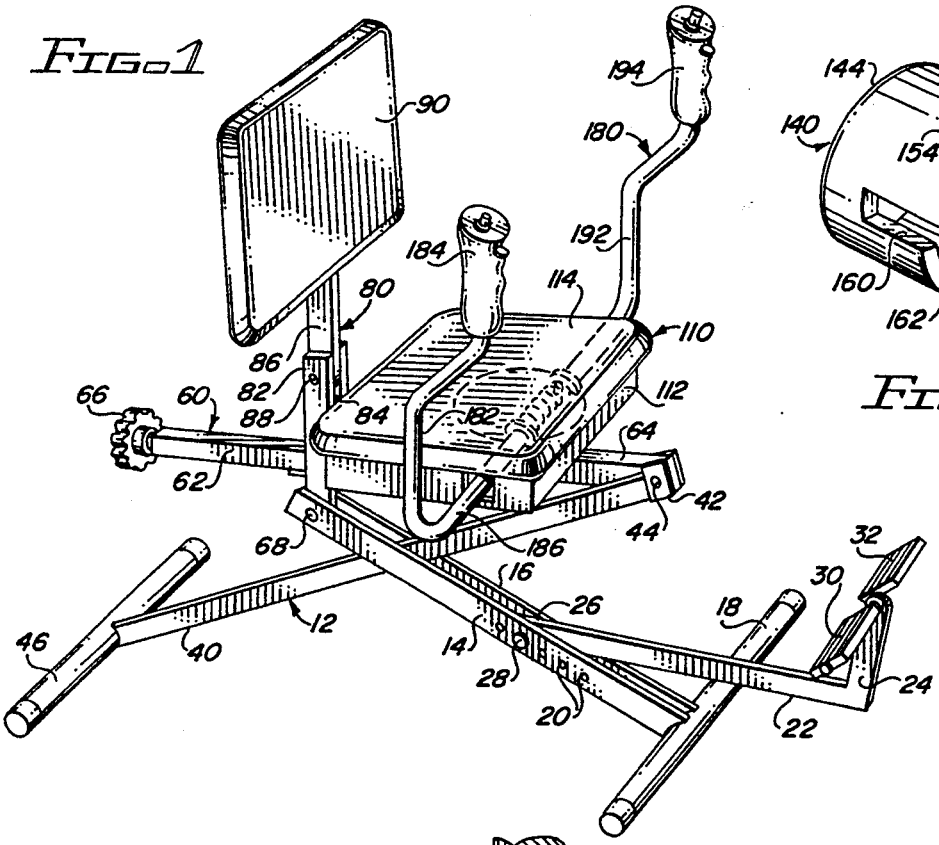
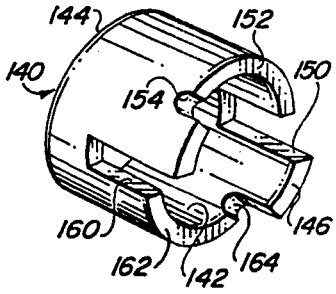
FIG. 7
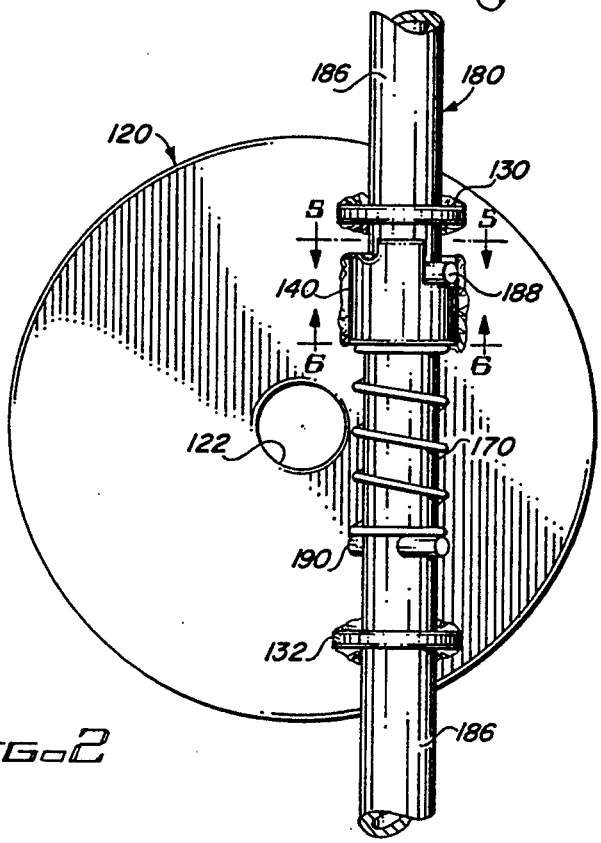
FIG. 2
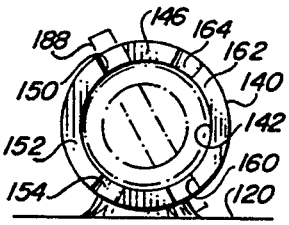
FIG. 5
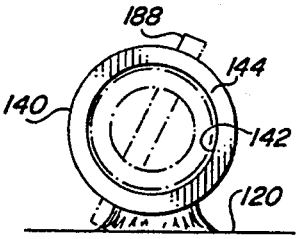
FIG. 6

FIG. 3
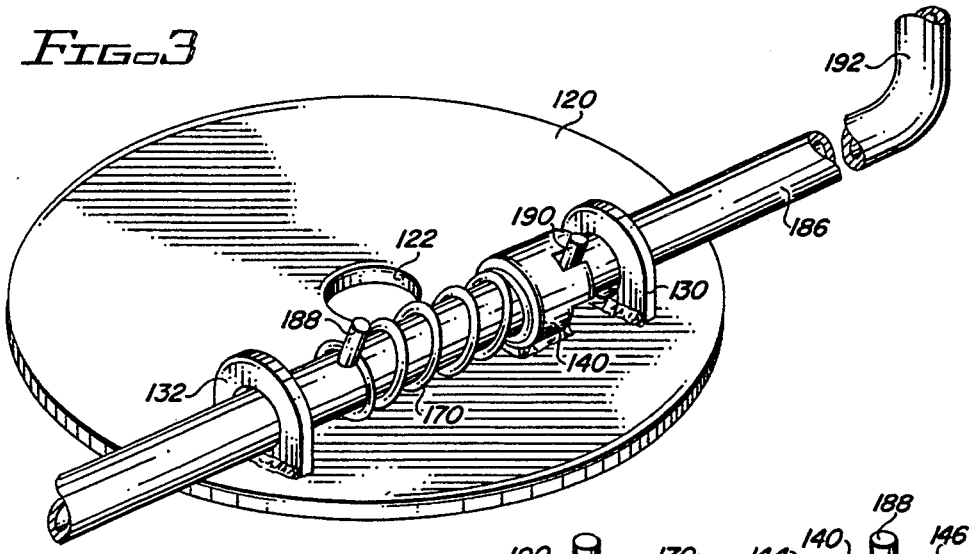
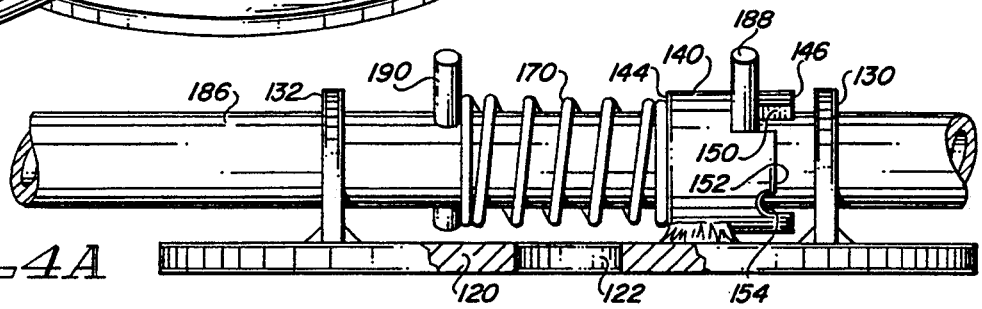
FIG. 4A
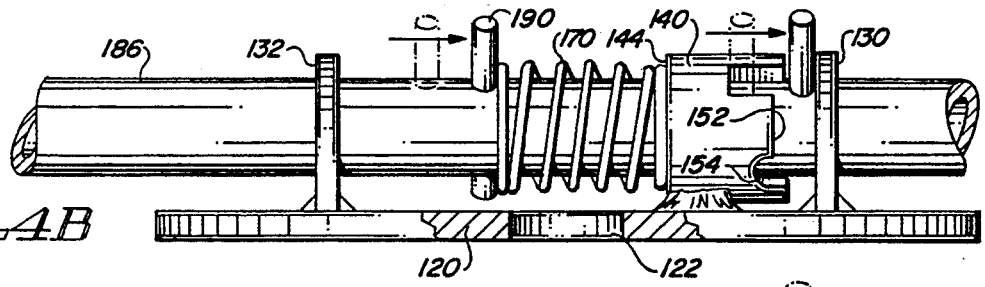
FIG. 4B
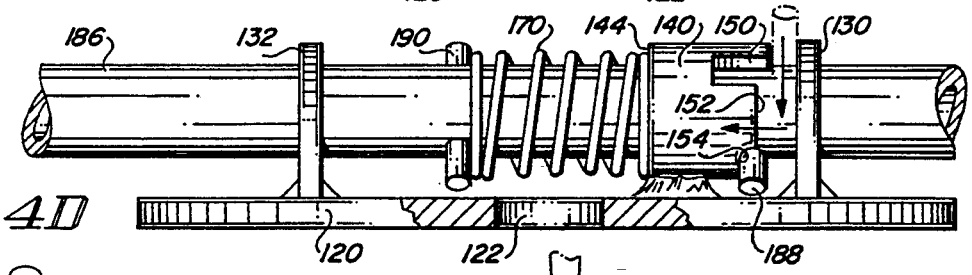
FIG. 4D
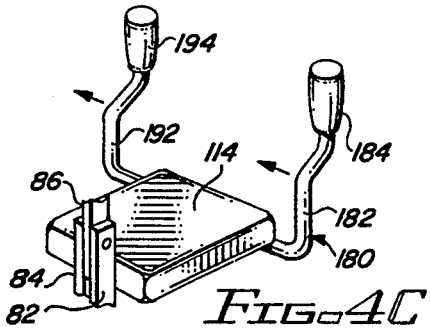
FIG. 4C
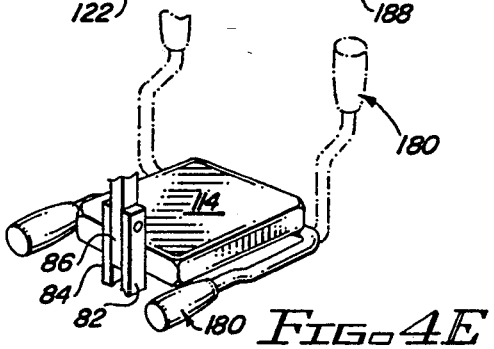
FIG. 4E

FOLDING HANDLE ASSEMBLY

BACKGROUND OF THE INVENTION

1. Field of the Invention

This invention relates to folding handles and, more particularly, to folding handle apparatus for a game chair.

2. Description of the Prior Art

For playing different types of video games, a chair may be utilized by a player, and the chair may include a joy stick or handle with finger and thumb trigger elements. The joy stick or handle may also be secured to a plate which is pivotable for actuating electrical elements. Thus, through the medium of the handle or joy stick, a number of signals may be transmitted to the video game apparatus.

The game chair, to be most efficient, is preferably collapsible for storage purposes. In order for the chair to collapse to a minimum height for storage purposes, the handle or joy stick must be able to fold downwardly from its up, use position to a down, storage position. One particular embodiment of such a folding joy stick or handle is shown in U.S. patent application Ser. No. 08/009,921, filed Jan. 15, 1993, for GAME CHAIR APPARATUS. In that application, the joy stick or handle includes a plate through which an aperture extends. In the up, or use position, the aperture is disposed on a threaded stud and is secured thereto by a wing nut. In order to fold the handle or joy stick, the wing nut is removed and the handle or joy stick is pivoted downwardly.

The mechanical elements involved in the handle or joy stick in the '921 application require that the seat be pivoted upwardly from the control box to which the seat is secured. The pivoting of the seat allows the user to have access to the elements within the control box so that the handle or joy stick may be secured to and removed from the threaded stud.

The apparatus of the present invention allows a handle or joy stick to be moved between a down, storage position and an up, use position without requiring a pivoting seat, and thus allowing the control box to be sealed. This prevents inadvertent problems by allowing a user access to the various components or elements within the control box.

SUMMARY OF THE INVENTION

The invention described and claimed herein comprises a handle or joy stick for a game chair and the handle or joy stick is connected to a plate which is moved or pivots in response to movement of the handle or joy stick to actuate a number of switch elements. The handle is biased by a compression spring which extends between a pin secured to the handle and a bushing which is secured to the plate. The bushing includes appropriate slots and relieved elements which receive a limit pin secured to the rod. To free the limit pin from its slots or detentes, a handle is moved against the bias of the compression spring and the handle, once the limit pin is free of its slot or detentes, may be appropriately pivoted, as desired.

Among the objects of the present invention are the following:

To provide new and useful game chair apparatus;

To provide new and useful handle or joy stick apparatus for a game chair;

To provide new and useful handle apparatus for a game chair in which the handle pivots between a down, storage position, and an up, use position;

To provide new and useful handle apparatus for a game chair in which the handle is secured to a movable plate;

To provide new and useful handle apparatus for a game chair in which the handle apparatus is biased into position by a compression spring; and To provide new and useful handle apparatus having a limit pin movable into and out of engagement with a plurality of slots and detentes on a bushing for locking the handle in either of two positions.

BRIEF DESCRIPTION OF THE DRAWING

FIG. 1 is a perspective view of the handle apparatus of the present invention in its use environment.

FIG. 2 is a top view of the apparatus of the present invention in its use environment.

FIG. 3 is a perspective view of the apparatus of FIG. 2.

FIG. 4A is a rear view of the apparatus of the present invention.

FIG. 4B is a view sequentially following 4A and illustrating the operation of the apparatus of the present invention.

FIG. 4C is a perspective view illustrating the operation detailed in FIG. 4B.

FIG. 4D is a view sequentially following FIG. 4B illustrating the operation of the apparatus of the present invention.

FIG. 4E is a perspective view of a portion of the chair apparatus illustrating the operation of FIG. 4D.

FIG. 5 is a view in partial section taken generally along line 5–5 of FIG. 2.

FIG. 6 is a view in partial section taken generally along line 6—6 of FIG. 2.

FIG. 7 is a perspective view of a portion of the apparatus of the present invention.

DESCRIPTION OF THE PREFERRED EMBODIMENT

FIG. 1 is a perspective view of game chair apparatus 10 which includes the folding handle or joy stick of the present invention. The chair apparatus 10 comprises the use environment of the present invention.

The chair apparatus 10 includes a base 12 which includes generally four primary elements appropriately secured together. There is a pair of front members 14 and 16 which preferably comprise lengths of strap material and to which is secured a transversely extending front stabilizer 18. Along the length of the members 14 and 16, and extending rearwardly from the front stabilizer 18, is a plurality of apertures 20. The purpose of the apertures 20 is to enable a foot rest 22 to be secured to the members 14 and 16 at various locations, as desired.

The foot rest 22 comprises a generally L shaped member 24, with the long arm of the member 24 secured to the members 14 and 16 through a bracket 26 and a screw 28. The short arm of the member 22 supports a pair of foot pedals or foot rests 30 and 32. The foot rests or pedals 28 and 30 extend generally perpendicularly outwardly from the short arm of the member 22.

If desired, the foot rests or pedals 30 and 32 may include switches or other sensors which provide an output signal in response to movement of the pedals or foot rests.

The bracket 26 is simply a generally U shaped bracket which includes a pair of aligned holes. The holes in the bracket 24 are aligned with a hole in the end of the long arm of the member 24 and with an aligned pair of holes 20 in the members 14 and 16 for securing the foot rest 22 to the members 14 and 16.

The base 12 also includes a rear member 40. The member 40 includes a front cap 42 and a rear stabilizer 46. The rear stabilizer 46 is generally parallel to the stabilizer 18 of the front members 14 and 16. The cap 42 is at the front or upper end of the member 40, remote from the rear stabilizer 46. The stabilizers 18 and 46 are generally parallel to each other and provide lateral stability for the chair apparatus 10.

The front cap 42 comprises a generally U shaped member preferably secured, as by welding, to the front end of the member 40. The front cap 42 extends upwardly from the member 40 to allow the member 40 to be secured to a horizontal assembly 60. For such securement, the end cap 42 includes a pair of aligned apertures which receive an appropriate fastening element, such as a pin or bolt 44, to secure the member 40 to the horizontal assembly 60.

The member 40 is appropriately pinned between the straps or members 14 and 16 between the front end cap 42 and the rear stabilizer 46.

The horizontal assembly 60 is the third major portion of the base 12.

The horizontal assembly 60 includes a pair of telescoping tubes, including a rear outer tube or sleeve 62 and a front inner tube 64. The front tube 64 is secured to the cap 42 by the pin or bolt 44. At the rear of the outer tube 62 is a rotatable handle 66. The handle 66 is secured to a threaded rod (not shown) which extends through a threaded bushing (also not shown) secured to the front member 64. The shaft is appropriately supported in the member 62. Rotation of the handle 66 raises and lowers the height of a seat assembly 110 secured to the horizontal assembly 60 through the telescoping of the members 62 and 64 and a scissors strut type mechanical linkage of the base 12 and the horizontal assembly 60.

The base 12 may also be essentially collapsed for storage and transport by the scissors strut arrangement, as may be understood.

A chair or seat back assembly 80 is secured to the horizontal assembly 60, and specifically to the outer tube or sleeve 62 thereof.

The chair back assembly 80 includes a channel bracket 82 which extends upwardly from and is appropriately secured as by welding, to the sleeve or tube 62, and to the upper ends of the members 14 and 16 by a pin or bolt 68. The bracket 82 includes a slot 84 which extends downwardly from the upper part of the bracket 82. A vertical support member 86 is disposed in the slot 84 and is appropriately pinned to the upper portion of the bracket 82 by a pin or bolt 88. A cushion or chair back 90 is appropriately secured to the upper portion of the vertical support member 86.

A seat assembly 110 is appropriately secured as by welding, to the top of the rear outer tube 62 of the horizontal assembly 60. The seat assembly 110 includes a generally rectangularly configured housing 112, which is essentially a box, and which is secured to the horizontal assembly 60. Disposed on the top of the housing 112 is a seat cushion 114.

Within the housing 112 is a circular plate 120. The plate 120 is shown in FIGS. 2, and 3, and also in FIGS. 4A, 4B, and 4D. The plate includes a central aperture 122 which is used for securing the plate 120 to the housing 112. This is all explained in detail in the application referred to above in the Description of the Prior Art portion of the specification.

For purposes of the present invention, the plate 120 pivots within the housing 112 to actuate four switches, not shown. The plate 120 pivots in response to movements of a handle assembly 180.

The handle assembly 180 includes a pair of generally vertical arm portions 182 and 192. The arm portions 182 and 192 are secured to and extend upwardly from a center portion 186. The vertical arms 182 and 192 terminate upwardly in a pair of hand grip elements 184 and 194, respectively. The hand grips 184 and 194 include appropriate trigger switches for actuating various elements of the video game with which the chair apparatus 10 is used.

The center portion 186 of the handle assembly 180 is appropriately secured to the plate 120. The securing of the handle assembly to the plate is illustrated in FIGS. 2–7.

A pair of bushings 130 and 132 are appropriately spaced apart and secured to the top of the plate 120. The center portion 186 of the handle assembly 180 extends through the bushings 130 and 132. The bushings 130 and 132 are spaced apart from each other. Between the bushings 130 and 132, and closer to the bushing 130 than the bushing 132, is a collar 140. The collar 140 is also appropriately secured to the top of the plate 120.

Details of the collar 140 are best shown in FIG. 7, but are also shown in FIGS. 2, 3, 4A, 4B, 4D, and 5 and 6, and for the following discussion, reference will be made to all of those figures.

The collar 140 is a generally cylindrical element which includes a central bore 142 through which the center portion 186 of a handle assembly 180 extends. The bore 142 extends between a pair of end faces 144 and 146. The end face 144 is generally flat and circular in extent. However, the end 146 is discontinuous in that a pair of slots and their associated elements extend inwardly into the collar 140 from the end face 146.

The slots which extend inwardly from the end face 146 of the collar 140 include a slot 150 and a slot 160. The slots 150 and 160 are diametrically aligned with each other. The slots 150 and 160 extend axially inwardly into the collar 140 from the end face 146 for a relatively long distance.

The slot 150 and the slot 160 are generally parallel to and aligned with each other. A cam surface 152 extends circumferentially between the slot 150 and a slot or detente 154. The slot or detente 154 is not axially as long as is the slot 150. The slot or detente 154 is generally rounded adjacent to the cam surface 154. A parallel cam surface 162 extends between the slot 160 and a relatively short slot or detente 164. Again, the slot or detente 164 is rounded, for purposes which will be explained below.

Extending through the center portion 186 of the handle assembly 180 are two pins, a pin 188 and a pin 190. The pins 180 and 190 are generally parallel to each other and they are appropriately secured to the center portion 186 of the handle. The pins 188 and 190 extend radially outwardly from the center portion 186 of the handle 180. The pin 188 is disposed adjacent to the bushing 130, and it extends into the slots in the collar 140. The pin 190 is disposed adjacent to the bushing 132.

A compression spring 170 is disposed between the end 144 of the collar 140 and the pin 190. The compression spring 170 urges the pin 190 and the handle assembly 180 toward the bushing 132, and accordingly urges the pin 188 into the slots in the collar 140. In other words, the spring 170, a compression spring, urges the center portion 186 of the handle assembly 180 laterally relative to the plate 120 and to the bushings 130 and 132 thereon.

Essentially, the force of the spring 170, together with the pin 188, locks the handle assembly 180 relative to the plate 120. When the handle assembly 180 is in its up, or use position, as shown in FIG. 1, the pin 188 is disposed in the slots 150 and 160. To pivot the handle assembly 180 downwardly to its storage position, as shown in FIG. 4E, the handle assembly 180, and particularly the center portion 186 thereof, is moved against the bias of 170 to move the pin 188 out of the slots 150 and 160. When the pin 188 is free from the slot 150 and 160, the handle may be pivoted downwardly, as indicated in FIG. 4E.

The downward pivoting movement of the handle assembly 180 causes the outer portions of the pin 188 to move along the cam surfaces 152 and 162 and into the relatively short slots or detentes 154 and 164.

When the handle assembly 180 is in its down position, the bias of the spring 170 urges the pin 180 into the detentes or slots 154 and 164.

Because the slots or detentes 154 and 164 are relatively shallow and are rounded, a specific movement of the handle assembly 180 against the bias of the spring 170 is not required to move the handle from its down, storage position to its up, use position. Rather, a simple upward tug or pull on the handle arms 182 and 192 will cause the pin 188 to move out of the slots or detentes 154 and 164 and to move upwardly along the cam surfaces 152 and 162 to the slots 150 and 160. The rounded portions of the short slots or detentes 154 and 164 act as cam surfaces for the pin 188 in moving the handle assembly 180 from the down, storage position to the up, use position. That is, a relatively small force acting on the arms 182 and 192 causes the pin 188 to move out of the detentes 154 and 164. A continued force then moves the arms or handles 182 and 192 upwardly to the use position.

When the pin 188 is aligned with the slots 150 and 160, the bias of the spring 170 causes the pin 188 to move into the slots 150 and 160, thus moving the handle assembly 180, and particularly the center portion 186, laterally or sideways to lock the handle assembly 180 in its up, use position.

The amount of force required to move the center portion 186 of the handle 180 laterally against the bias of the spring 170 will, of course, depend on the strength of the spring 170.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Folding handle apparatus for a game chair comprising in combination:

plate means pivotable for actuating switches;

handle means secured to the plate for moving the plate means to actuate the switches and pivotable between an up, use position and a down, storage position, including a first portion secured to the plate means and a second portion secured to the first portion for grasping by a user for moving the plate means, and pin means, including first pin extending outwardly from the first portion for locking the handle means in the up and down positions; and collar means secured to the plate means for receiving the first portion of the handle means for locking the handle means in both the up position and in the down position, including a bore through which the first portion of the handle means extends, a first slot for receiving the first pin means for locking the handle means in the up position, and a second slot for receiving the first pin means for locking the handle means in the down position.

2. The apparatus of claim 1 in which the plate means includes a plate and a pair of bushings spaced apart from each other and secured to the plate, and the first portion of the handle means extends through the pair of bushings.

3. The apparatus of claim 2 in which the collar means is secured to the plate between the bushings.

4. The apparatus of claim 3 in which the pin means further includes a second pin extending outwardly from the first portion of the handle means spaced apart from the first pin.

5. The apparatus of claim 4 in which the handle means further includes spring means between the second pin and the collar for biasing the handle means in a first direction to urge the first pin into both the first and second slots.

6. The apparatus of claim 5 in which the second slot comprises a detente for receiving the first pin, and the handle means is moved generally upwardly to move the first pin out of the second slot to pivot the handle means to the up position.

7. The apparatus of claim 1 in which the first slot comprises an elongated slot and the handle means is moved against the bias of the spring means to move the first pin out of the first slot for pivoting the handle means to the down position.

8. The apparatus of claim 1 in which the collar means further includes a cam surface extending between the first and second slots on which the first pin means moves between the first and second slots.

9. Folding handle apparatus comprising in combination:

a handle, including at least a single arm and a generally horizontal portion secured to the arm, pivotable between an up position and a down position;

a first pin secured to and extending outwardly from the generally horizontal portion;

a plate;

a collar secured to the plate;

a bore in the collar through which the generally horizontal portion of the handle extends; and a first slot in the collar for receiving the first pin for locking the handle in the up position.

10. The apparatus of claim 9 which further includes a second slot in the collar for receiving the first pin for locking the handle in the down position when the handle is pivoted away from the up position.

11. The apparatus of claim 10 which further includes a spring for urging the generally horizontal portion of the handle in a first direction to bias the first pin into the first and second slots in the respective up and down positions of the handle.

12. The apparatus of claim 11 which further includes a second pin secured to the generally horizontal portion of the handle, and the spring extends between the collar and the second pin.

* * * * *